United States Patent [19]

Gettleman

[11] 4,277,067

[45] Jul. 7, 1981

[54] GAME DEVICE WITH BOARD SURFACES VISIBLE ONLY TO OPPOSING PLAYERS

[76] Inventor: Sara L. Gettleman, 9846 N. Kendall Dr., Apt. A114, Miami, Fla. 33176

[21] Appl. No.: 45,233

[22] Filed: Jun. 4, 1979

[51] Int. Cl.[3] ..... A63F 3/00

[52] U.S. Cl. ..... 273/271; 273/285; 273/287

[58] Field of Search ..... 273/241, 265, 271, 285, 273/287

[56] References Cited

U.S. PATENT DOCUMENTS

| | | | |
|---|---|---|---|
| 3,139,281 | 6/1964 | Nicholson | 273/285 X |
| 3,506,267 | 4/1970 | Taillie | 273/271 X |
| 3,550,943 | 12/1970 | Hatcher | 273/265 X |
| 3,895,806 | 7/1975 | Burns | 273/287 X |
| 4,022,473 | 5/1977 | Foley | 273/265 |

FOREIGN PATENT DOCUMENTS

| | | | |
|---|---|---|---|
| 1352501 | 5/1974 | United Kingdom | 273/271 |

*Primary Examiner*—Anton O. Oechsle
*Attorney, Agent, or Firm*—Harvey B. Jacobson

[57] ABSTRACT

An upright board having a plurality of through holes arranged in a symmetrical grid pattern and a plurality of pegs positionable in the holes by opposing game participants. The board is oriented in a vertical or upright position between opposing game participants to place pegs in the holes in the board in accordance with special dice and rules of play. In one embodiment, the board is supported by a pair of laterally extending trays hingedly connected to the lower portion of the board and including an area for receiving the dice and compartments for storing the pegs in accordance with distinguishable colors on the pegs. The trays are hinged to the board slightly above the bottom edge thereof so that when the trays are disposed in vertical position alongside the board and secured in place, the lower end of the board will project beyond the trays with the projecting edge of the board including a handle structure incorporated therein to facilitate the game device being carried or handled. In another embodiment, the board is detachably supported on the tray in a vertical position and can be slid onto the tray in horizontal position for use as a closure. The object of the game is to orient pegs of a particular color in a vertical, horizontal or diagonal row of a predetermined number of pegs with the central hole on the board being designated a starting hole or position. Score recording holes are also provided in the board for receiving score pegs.

9 Claims, 5 Drawing Figures

LINE 5

LINE5

GAME DEVICE WITH BOARD SURFACES VISIBLE ONLY TO OPPOSING PLAYERS

BACKGROUND OF THE INVENTION

The present invention generally relates to a game device and more specifically to an upright board having holes therein for receiving distinguishably colored pegs alternatively placed in holes in accordance with dice and predetermined rules of play.

SUMMARY OF THE INVENTION

An object of the present invention is to provide a game device having an upright board with holes therethrough arranged in a grid pattern combined with pegs insertable into the holes by opposing players of the game with the pegs having distinguishable color characteristics and placed in the holes in accordance with chance control dice with the players not being able to observe the colors of the pegs on their opponent's side of the board.

Another object of the invention is to provide a game device in accordance with the preceding object in which the board is supported in an upright position by a pair of laterally extending trays hingedly connected to the bottom edge portion of the board with each tray including an area for receiving the chance control dice and a compartmented area for storage of the pegs categorized in accordance with their color characteristics.

Still another object of the invention is to provide a game device in accordance with the preceding objects in which the trays are hingedly attached to the board at a point spaced above the bottom edge thereof so that the lower surfaces of the trays and the lower edge of the board will be coplanar when the board is in upright position and the lower edge portion of the board will project beyond the trays when the trays are hinged to a position along side of the board with the projecting lower edge portion of the board having a handle structure incorporated therein to facilitate carrying and handling of the game device.

A further object of the invention is to provide a game device in accordance with the preceding objects in which the peg receiving holes include a central starting hole and score recording holes for receiving score pegs.

Still another important object of the present invention is to provide a game device which is simple in construction, highly entertaining, educational, combines the elements of luck, strategy and memory and is capable of use in playing many games and many adaptations thereof.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3, 4, 5:
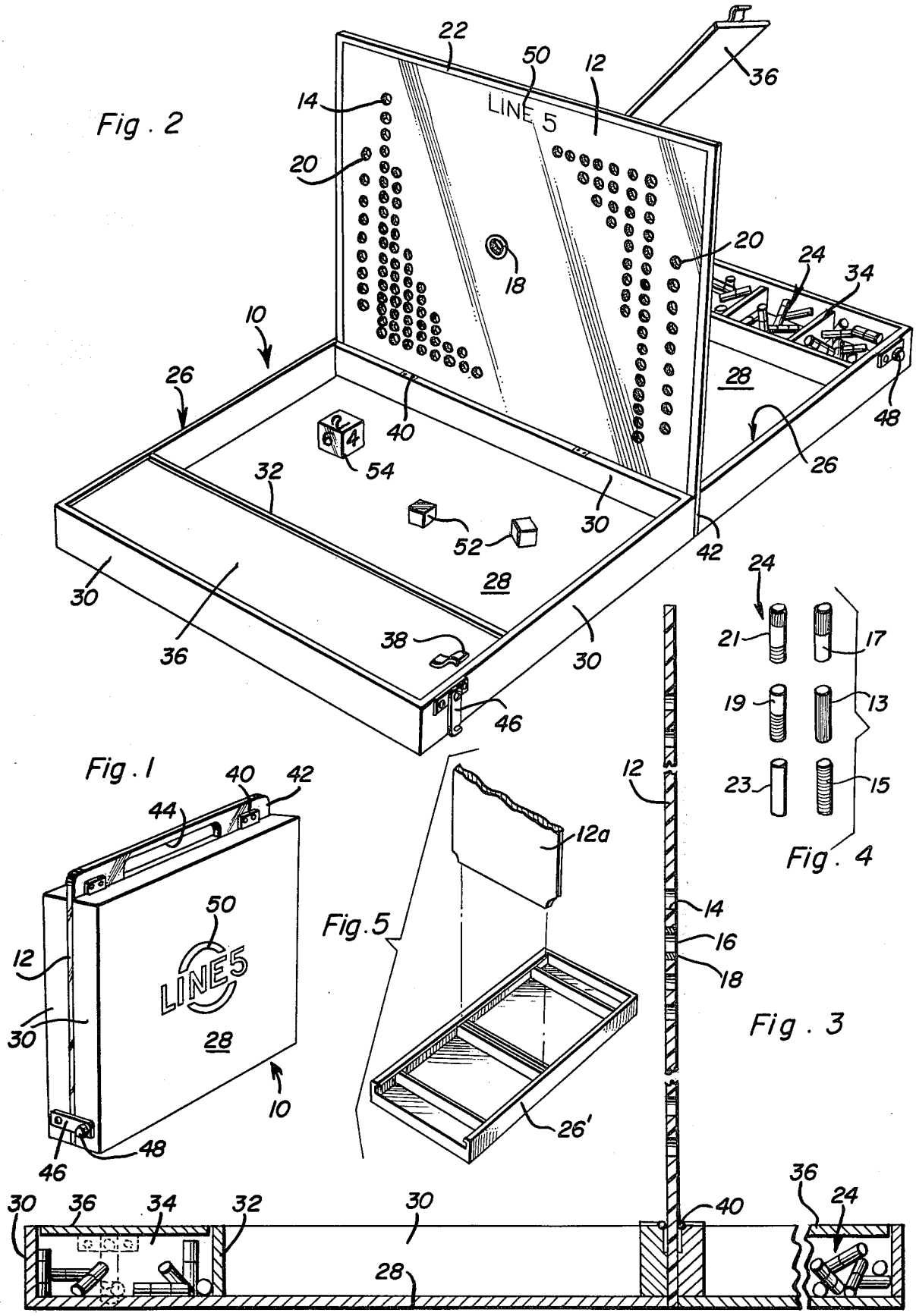
FIG. 1 is a perspective view of the game device of the present invention in its transport or carrying position.
FIG. 2 is a perspective view of the game device set up in position for playing a game by opposing players.
FIG. 3 is a longitudinal, sectional view generally along the longitudinal center of the game device illustrating specific structural details thereof.
FIG. 4 is a group perspective view illustrating typical pegs used in playing a game with the game device.
FIG. 5 is a perspective view of another embodiment of the invention.

Referring now specifically to the drawings, the game device of the present invention is generally designated by reference numeral 10 with FIG. 1 illustrating the game device when it is in its folded condition or carrying position to indicate the manner in which the game device may be easily transported or carried to a desired location. FIG. 2 illustrates the game device 10 set up in the manner of use by a pair of opposing players.

The game device 10 includes a generally rectangular board or panel 12 of opaque material and conveniently may be constructed of plastic or other material such as wood, fiberboard, cardboard, metal or the like. Arranged in the board 12 is a plurality of playing holes 14, all of which are of the same size and arranged in a symmetrical grid pattern in which the holes are in vertical and horizontal rows. The central hole 16 is provided with a distinguishably colored ring or grommet 18 therein which distinguishes this hole as a starting hole. Positioned along each side edge of the board 12 is a plurality of score recording holes 20 which may be conveniently oriented in a vertical row of less height than the vertical rows of playing holes 14. If desired, a border or frame-like structure 22 may be provided along the side and top edges of the board 12. The holes 14, 16 and 20 are of the same size to receive pegs 24 which are of cylindrical construction and distinguishably colored as defined in more detail hereinafter with FIG. 4 illustrating typical pegs 24.

In order to support the board 12 in a vertical or upright position, a tray 26 is positioned along opposite surfaces of the board 12. Each tray 26 includes a bottom panel 28 and an upstanding peripheral wall 30 secured thereto in any suitable manner. The interior of the tray defined by the peripheral wall 30 includes a partition wall 32 paralleling the board 12 but spaced closer to the outer portion of the peripheral wall 30 than to the portion of the peripheral wall 30 alongside the board 12. Interconnecting the partition wall 32 and the outer portion of the peripheral wall 30 is a plurality of partitions 34 which are in spaced parallel relation to each other and define a plurality of compartments for receiving a plurality of pegs 24 with pegs of similar color characteristics being placed in the various compartments defined by the partitions 34. A cover lid 36 is provided for the compartments and is disposed in overlying relation to the partitions 34 with one end edge of the cover lid 36 being hingedly connected to the peripheral wall 30 by a suitable fabric hinge or other suitable structure and the other end edge of the cover lid 36 being provided with a lift tab 38. Any suitable means may be provided for retaining the cover lid in place with the cover lid being hingedly attached or completely removable and being provided with suitable retaining means for retaining the cover lid 36 in position in order to retain the pegs 24 in compartments defined by the partitions 34.

The upper edge of the inner portion of the peripheral wall 30 is hingedly attached to the board 12 by hinges 40 which define hinge axes spaced above the bottom edge of the board 12 at a distance equal to the height of the trays 26 as illustrated in FIG. 3. With this structure, when the trays 26 are hinged upwardly to a position along side of and against the board 12, the lower edge portion of the board 12 will project below the horizontal plane of the portions of the peripheral wall 30 attached to the board 12. The projecting portion of the board 12 is designated by numeral 42 and, as illustrated in FIG. 1, an elongated handle forming slot 44 is provided in the projecting portion 42 to facilitate the game device being transported or carried to a desired location for use.

In order to retain the trays 26 in a position against the opposite surfaces of the board 12, pivotal latch members 46 are mounted on one of the trays 26 and releasably engages a keeper 48 on the opposite tray with the latch 46 and keeper 48 being disposed adjacent the outer side edges of the trays 26 as illustrated. Various types of releasable catches, fastening devices and the like may be employed to releasably secure the trays 26 in position against opposite surfaces of the board 12. The outer surfaces of the bottom panels 28 of the trays may be provided with indicia 50 and similar indicia may be provided on the upper edge of the board 12 designating the trademark or other information regarding the game device.

The game device also includes a pair of special game dice 52 and a larger high roller cube 54 with the dice 52 having three distinguishably colored surfaces and three neutral surfaces corresponding with the colors and neutral incorporated into the pegs 24. Usually 200 playing pegs 24 are provided and 20 scoring pegs are provided with the basic purpose of the game being to align 5 (or any other number) identically colored pegs in a row, either vertically, horizontally or diagonally. By mutual agreement, each player uses a color, either red or blue in this instance, and positions himself on the corresponding side of the game board. The player who gets the top score on the high roll cube 54 starts the game by rolling the dice 52 and placing the appropriately colored peg in the center hole of the gameboard.

In playing the game, after the initial play, the roll of the dice alternates between players and with each player's turn, a peg is strategically placed in a hole in the gameboard which hole must be adjacent to a peg already in the board. For each player, only his selected color or neutral may appear on his side of the gameboard. As illustrated in the group perspective view of FIG. 4, the pegs 24 include a plurality of red pegs 13 and a plurality of blue pegs 15 used for scoring and also a plurality of pegs 17 which have one end red and the other end neutral, a plurality of pegs 19 having one end blue and the other end neutral, a plurality of pegs 21 having one end red and one end blue with the central area neutral and a plurality of pegs 23 which are neutral in color throughout their length. A neutral color may be either the color of natural wood or white or any other designated color. In playing the game, if "blue" rolls a blue/neutral combination of dice, he places a blue/neutral peg in an appropriate hole with the blue tip facing him. If "blue" rolls a red/neutral, the red tip will show on the other player's side. The same procedure is followed for all possible combinations which may be rolled. During the game, a player may not see his opponent's side of the gameboard. The challenge of the game is remembering the rolls of the dice and where the pegs are placed. The player who makes his line of 5 appropriately colored pegs in a row is the winner, even if that turn also gives the other player a line of 5 pegs. You also win if your opponent sets up 5 pegs in a row on your side before he does. The pair of dice has surfaces colored blue and red and also neutral surfaces so that the color combination designated by the dice control the selection of pegs with one die having red and neutral surfaces and the other die having blue and neutral surfaces. Rather than using a high roller cube, the first player may be selected by mutual agreement such as the blue player starting the game by placing the designated peg in the center hole. All other pegs must be placed in a hole adjacent to a peg already in the board and if the dice are cocked when they come to rest, they will be rolled again to designate the peg to be inserted. Thus, for each player, only his color or neutral may appear on his side of the board. Thus, if you are the blue player, in some instances, you will insert a peg that will assist your opponent since if the blue player rolls dice indicating a partially red peg, then the red end of the peg must be inserted through the board so that it is visible from his opponent's side of the board thus introducing the capability that placement of a peg by the blue player could cause the red player to win the game. Thus, memory characteristics must be developed in order to effectively play a game.

Many variations may be utilized such as aligning more or less than 5 pegs in a row, forming a shape with a peg such as a letter of the alphabet, a numeral, a geometric shape or the like. Games using partners may be played with the opposing participants alternating turns and the players on one team will be prohibited from conferring with each other.

FIG. 5 illustrates a form of the game device in which the board **12*a* is provided with a vertical detachable connection to the tray 26'** which is a rigid structure and forms a horizontal sliding closure for the tray when removed and positioned in overlying relation thereto. Additionally, the game device may be incorporated into electrical models of various structures including lights, switches and the like, all of which involve the same basic principles of component relationship. Also, removable tray-like inserts may be provided in each tray segment so that the players can remove the insert and place it alongside the tray and roll the dice in the insert so that the results can be observed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A game device comprising a board having playing surfaces visible only to opposing players, visually distinguishable means sequentially rendered operative by opposing players and chance control means sequentially actuated by the opposing players to indicate to the opposing players which distinguishable means is to be made operable, said visually distinguishable means including means visible by each of the opposing players whereby operation of the visually distinguishable means may affect the association of the individual visually distinguishable means on both surfaces of the board, said board including a plurality of holes therethrough arranged in a grid pattern, said visually distinguishable means including pegs insertable into the holes, said pegs having distinguishable colored areas with at least one colored area being visible to one side of the board and another colored area being visible from the other side of the board when the pegs are inserted in the holes whereby a player inserting a peg from one side of the board provides a visually distinguishable colored peg portion visible from the opposite side of the board, said game device further including a tray extending outwardly from each side of a lower portion of the game board, said tray including compartments for storing said pegs which have been separated into different categories, and further including hinge means securing the trays to the lower portion of the board for pivotal movement to a position alongside the opposite surfaces of the board, the lower portion of the board projecting below the trays when they are positioned alongside the board with the projecting lower portion of the board including a slot-like handle formed thereon to enable transportation of the game device.

2. A structure as defined in claim 1 together with additional holes in the board spaced from the grid pattern for receiving solid colored pegs to record the scores of the players.

3. The game device as defined in claim 2 wherein each tray includes a playing area located between the compartments and the lower portion of the board, said playing area receiving said chance control means, said chance control means including dice having colored surfaces corresponding to the colors of the pegs.

4. A game device comprising a vertical board having playing surfaces visible only to opposing players, visually distinguishable means sequentially rendered operative by opposing players and chance control means sequentially actuated by the opposing players to indicate to the opposing players which distinguishable means is to be made operable, said visually distinguishable means including means visible by each of the opposing players whereby operation of the visually distinguishable means may affect the association of the individual visually distinguishable means on both surfaces of the board, said board further including a plurality of holes therethrough arranged in a grid pattern, said visually distinguishable means including pegs insertable into the holes, said pegs having distinguishable colored areas with at least one colored area being visible to one side of the board and another colored area being visible from the other side of the board when the pegs are inserted in the holes whereby a player inserting a peg from one side of the board provides a visually distinguishable colored peg portion visible from the opposite side of the board, said game device further having a rigid tray extending from both sides of the vertical board, means removably mounting the board in a vertical position on the tray, and means slidably mounting the board horizontally on the tray to form a closure therefor.

5. A game device comprising a board having playing surfaces visible only to opposing players, visually distinguishable means sequentially rendered operative by opposing players and chance control means comprising dice sequentially actuated by the opposing players to indicate to the opposing players which distinguishable means is to be made operable, said visually distinguishable means including means visible by each of the opposing players whereby operation of the visually distinguishable means may affect the association of the individual visually distinguishable means on both surfaces of the board, said board including a plurality of holes therethrough arranged in a grid pattern, said visually distinguishable means including pegs insertable into the holes, said pegs having distinguishable colored areas with at least one colored area being visible to one side of the board and another colored area being visible from the other side of the board when the pegs are inserted in the holes whereby a player inserting a peg from one side of the board provides a visually distinguishable colored peg portion visible from the opposite side of the board, and further having trays with hinge means provided for securing said trays to a lower portion of the board for pivotable movement to a position alongside the opposite surfaces of the board, the lower portion of the board projecting below the trays when they are positioned alongside the board with the projecting lower portion including a slot-like handle formed thereon to enable transportation of the game device.

6. A game device comprising a board having playing surfaces visible only to opposing players, visually distinguishable means sequentially rendered operative by opposing players and chance control means comprising dice sequentially actuated by the opposing players to indicate to the opposing players which distinguishable means is to be made operable, said visually distinguishable means including means visible by each of the opposing players whereby operation of the visually distinguishable means may affect the association of the individual visually distinguishable means on both surfaces of the board, and further having trays with hinge means provided for securing said trays to a lower portion of the board for pivotal movement to a position alongside the opposite surfaces of the board, the lower portion of the board projecting below the trays when they are positioned alongside the board with the projecting lower portion of the board including a slot-like handle formed thereon to enable transportation of the game device.

7. The game device as defined in claim 5, wherein additional holes are provided in the board spaced from the grid pattern for receiving solid colored pegs to record the scores of the players.

8. The game device as defined in claim 7, wherein each tray includes a playing area located proximate the lower portion of the board, said playing area receiving said chance control means, said chance control means including dice having colored surfaces corresponding to the colors of the pegs.

9. A game device comprizing a board having playing surfaces visible only to opposing players, visually distinguishable means sequentially rendered operative by opposing players and chance control means comprising dice sequentially actuated by the opposing players to indicate to the opposing players which distinguishable means is to be operable, said visually distinguishable means including means visible by each of the opposing players whereby operation of the visually distinguishable means may affect the association of the individual visually distinguishable means on both surfaces of the board, and further including a rigid tray extending from both sides of said board, means removably mounting the board in a vertical position on the tray, and means slidably mounting the board horizontally on the tray to form a closure therefore.

* * * * *